US008478115B2

(12) United States Patent
Soresina et al.

(10) Patent No.: US 8,478,115 B2
(45) Date of Patent: Jul. 2, 2013

(54) ROTATING DEVICE FOR ELECTRICALLY CONNECTING ELECTRIC HOUSEHOLD APPLIANCES AND ELECTRIC TOOLS

(76) Inventors: Claudio Soresina, Morbio Inferiore (CH); Flavio Soresina, Mendrisio (CH)

( * ) Notice: Subject to any disclaimer, the term of this patent is extended or adjusted under 35 U.S.C. 154(b) by 315 days.

(21) Appl. No.: 12/920,639

(22) PCT Filed: Feb. 20, 2009

(86) PCT No.: PCT/IB2009/000318

§ 371 (c)(1),
(2), (4) Date: Sep. 2, 2010

(87) PCT Pub. No.: WO2009/109820

PCT Pub. Date: Sep. 11, 2009

(65) Prior Publication Data

US 2011/0002673 A1 Jan. 6, 2011

(30) Foreign Application Priority Data

Mar. 7, 2008 (CH) ..... 339/08

(51) Int. Cl.
*A47J 27/00* (2006.01)

(52) U.S. Cl.
USPC ..... 392/380; 439/823

(58) Field of Classification Search
None
See application file for complete search history.

(56) References Cited

U.S. PATENT DOCUMENTS

| | | | | |
|---|---|---|---|---|
| 1,699,678 | A | 1/1929 | Schellenger | |
| 3,064,232 | A * | 11/1962 | Lyman, Jr. | 439/823 |
| 3,091,484 | A * | 5/1963 | Laupot | 285/153.1 |
| 3,683,322 | A * | 8/1972 | Hults | 439/823 |
| 3,957,331 | A * | 5/1976 | Tantillo et al. | 439/20 |
| 5,425,645 | A * | 6/1995 | Skovdal et al. | 439/23 |
| 6,935,046 | B2 * | 8/2005 | Tang et al. | 34/97 |
| 2004/0221458 | A1 | 11/2004 | Pleshek | |
| 2007/0099499 | A1 | 5/2007 | Victor | |

FOREIGN PATENT DOCUMENTS

| | | |
|---|---|---|
| DE | 297 21 015 U1 | 1/1998 |
| DE | 200 17 310 U1 | 4/2001 |

OTHER PUBLICATIONS

International Search Report, dated Jul. 21, 2009, from corresponding PCT application.

* cited by examiner

*Primary Examiner* — Thor Campbell
(74) *Attorney, Agent, or Firm* — Young & Thompson

(57) ABSTRACT

A device for electrically connecting electric household appliances or electric tools, including a female receptacle provided with two seats, and a male connector which can be inserted inside the female receptacle. The male connector is provided with first and second means for electrically contacting that are concentric with each other, so as to allow rotation of the male connector with respect to the female receptacle.

7 Claims, 4 Drawing Sheets

ROTATING DEVICE FOR ELECTRICALLY CONNECTING ELECTRIC HOUSEHOLD APPLIANCES AND ELECTRIC TOOLS

BACKGROUND OF THE INVENTION

1. Field of the Invention

The present invention relates to the technical sector of devices for electrically connecting electric household appliances or electric tools.

The present invention concerns a device for electrically connecting electric household appliances or electric tools as defined in the preamble of Claim 1, comprising a female receptacle and a male connector which can be removably and rotatably inserted inside said female receptacle, such as a hair-drier provided with this device, as described in the preamble of Claim 6.

In the present description "electric household appliance" is understood as meaning an appliance for household use which uses electric energy and converts it into motive power or heat, for example: a hair-drier, a vacuum cleaner or an iron. "Electric tool" on the other hand is used to indicate an appliance for professional use such as, for example: a professional hair-drier, a drill, a saw or a sanding machine.

In the context of the present patent description the definition "male" is understood as meaning a part, or an end of a part, having a shape such as to enter into the corresponding recess of another part, in this case a female receptacle.

In the present description "connector" is understood as meaning an electrical connection means designed to allow the through-flow of a given electrical current from one end to the other of the connection device.

2. Description of the Related Art

It is known that an electric household appliance (or an electric tool) is provided with an electric cable for powering it in order to allow operation thereof. During use, the tool in question, assuming that it is of the mobile type, is moved around within space; the cable, since it is connected to the tool, follows it during the various spatial movements, becoming entwined about itself. This results in twisting of the cable, with a possible tangled mass of knots along it, depending on the spatial movements of the electric household appliance or electric tool.

A mechanical stress, in the case in question a twisting and/or a flexing action, occurs in the vicinity of the point where the cable is inserted into the electric household appliance or electric tool, as a result of the aforementioned entwining action, this resulting in wear of the cable and the corresponding sleeve at this point. Said wear may cause tearing of the cable insulation layer, therefore resulting in the possibility of the user coming into direct contact with the conductor wires, with a consequent risk of the user receiving an electric shock.

The formation of said tangled mass of knots along the cable also limits the freedom of movement of the electric household appliance or electric tool.

BRIEF SUMMARY OF THE INVENTION

The object of the present invention is to overcome the abovementioned technical drawbacks and to provide an electrical connection device which has a simple design and is able to prevent twisting of the power supply cable during use of the connected electric household device or electric tool, therefore preventing wear, due to mechanical action, of the cable at the point where it is inserted into the electric household appliance or electric tool.

The object is achieved by means of the structural parts described in the characterizing part of Claim 1, in this case a male connector which is seated inside a female receptacle by means of special electrical contact means, in particular a pin and a ring, which are removably connected inside retaining springs so that said male connector is able to rotate continuously with respect to the female receptacle.

The invention will now be better explained, in detail, with reference to the accompanying drawings which show in schematic form preferred embodiments provided, for the person skilled in the art, only by way of a non-limiting example, since technical or constructional variations may be made without departing from the scope of the present invention as described.

In said drawings:

BRIEF DESCRIPTION OF THE DRAWINGS

In FIG. 1 it is also possible to see the protective body 7 connected to the connection device 1 by means of suitable fixing means (not shown), such as, for example, one or more screws (not shown). In this view the male connector 3 is detached from the female receptacle 2.

DETAILED DESCRIPTION OF THE PREFERRED EMBODIMENTS

Figure 1:
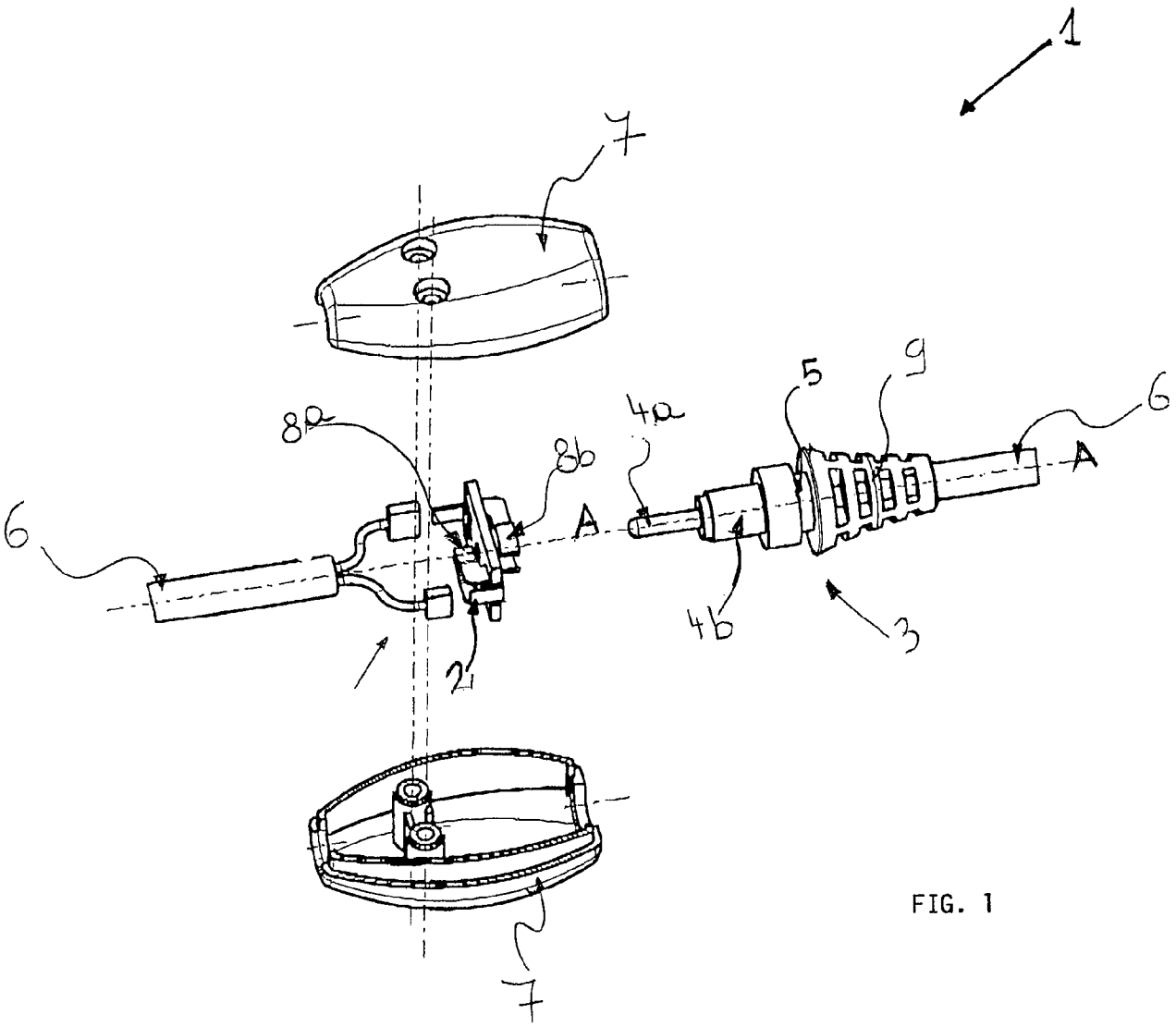
FIG. 1 shows an exploded axonometric view of the device 1 for electrically connecting electric household appliances or electric tools, in an embodiment thereof. The power supply cable 6 provided with sheathing, on the outside, and conductor wires, on the inside, is connected to the ends of both the male connector 3 and the female receptacle 2 so as to allow the through-flow of direct or alternating electric current from a power supply socket (not shown), at the conventional voltage of 230 V, to the electric household appliance (not shown) or to the electric tool (not shown). As may be noted from the drawing, the male connector 3 comprises two electrical contact means 4*a*, 4*b*: a pin 4*a*, having a longitudinal axis A-A, with a substantially cylindrical form and a ring 4*b* concentric with said pin 4*a*. Pin 4*a* and ring 4*b* can be both inserted inside two seats 8*a*, 8*b*, in this case two retaining springs 8*a*, 8*b*, with which the female receptacle 2 is provided, said retaining springs 8*a*, 8*b* having a substantially cylindrical form and being designed to seat/receive the pin 4*a* and ring 4*b*.
Figure 2:
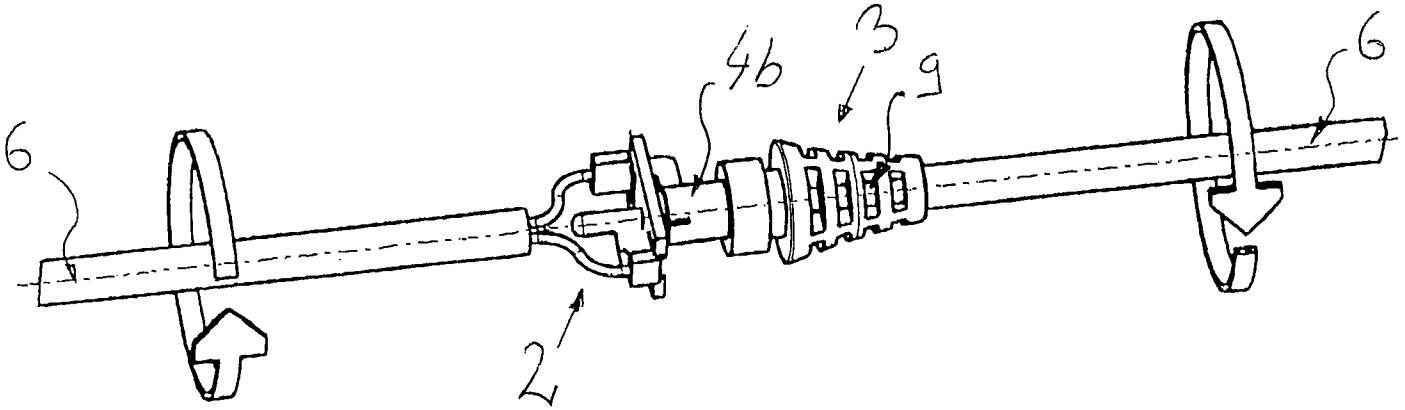
FIG. 2 shows an axonometric view of the device 1 for electrically connecting electric tools or electric household appliances, as shown in FIG. 1, but in the operating condition, namely with insertion of the male connector 3 inside the appropriate cavity of the female receptacle 2. The connection between male connector and female receptacle, as can be noted, is closed, therefore allowing the flow of electric current since the two electrical contact means 4*a*, 4*b* of the male connector 3 are positioned inside the appropriate seats 8*a*, 8*b* with which the receptacle 2 is provided.

The invention therefore relates to a device 1 for electrically connecting electric household appliances or electric tools, comprising a female receptacle 2 designed to seat a male connector 3 in such a way that it can be inserted inside said female receptacle 2, said connector 3 being provided with two electrical contact means 4*a*, 4*b* concentric with each other and formed in an embodiment by a pin 4*a* and a ring 4*b*.

The male connector 3 is provided with a plastic body 5 to which both the pin 4*a* and the ring 4*b*, made of a metallic type material, are fixed. The pin 4*a* and the ring 4*b* are concentric and therefore their longitudinal axis A-A is the same; said pin 4*a* and said ring 4*b* can be inserted and disengaged removably inside two seats 8*a*, 8*b* also of a metallic nature with which the female receptacle is provided. In this case the two seats consist of two retaining springs 8*a*, 8*b* which are of a metallic nature, therefore being designed to conduct the current, and have a substantially cylindrical form with a radius such as to allow insertion and disengagement of the pin and the ring and have suitable elastic properties.

Mating of the pin 4*a* and the ring 4*b* with the respective seats 8*a*, 8*b* is such as to allow continuous rotation of the male connector 3 about the longitudinal axis A-A of the pin 4*a* and the ring 4*b*.

Electrical conduction of the device according to the invention is ensured by the aforementioned connection and comprises a phase conductor and a neutral conductor, said conductors formed by the connection of the ring 4*b* to the respective connecting spring 8*b* and the pin 4*a* to the respective retaining spring 8*a* or vice versa.

The device 1 for electrically connecting electric household appliances or electric tools, in a particular embodiment thereof, is provided with a protection means 9 in the zone where the cable interfaces with said device, designed to protect the cable 6 from breakages caused by flexing.

The means 9 for providing protection against breakages caused by flexing has the function of protecting the cable 6 from tearing and is made of plastic, rubber or a combination of plastic/rubber; the material has a modulus of elasticity such as to prevent damage from wear, said wear being caused by a mechanical—flexing or twisting—action in the zone with the cable enters into the device 1 for the electrical connection.

With reference to one embodiment, the device 1 for electrically connecting electric household appliances or electric tools is enclosed in a protective body 7 made of plastic with a suitable dielectric and mechanical strength.

Preferably, the subject according to the invention, i.e. the device 1 for a connecting electric household appliances or electric tools, is arranged along the power supply cable 6 at a distance of a few centimeters from the electric household appliance or electric tool.

Figure 3:
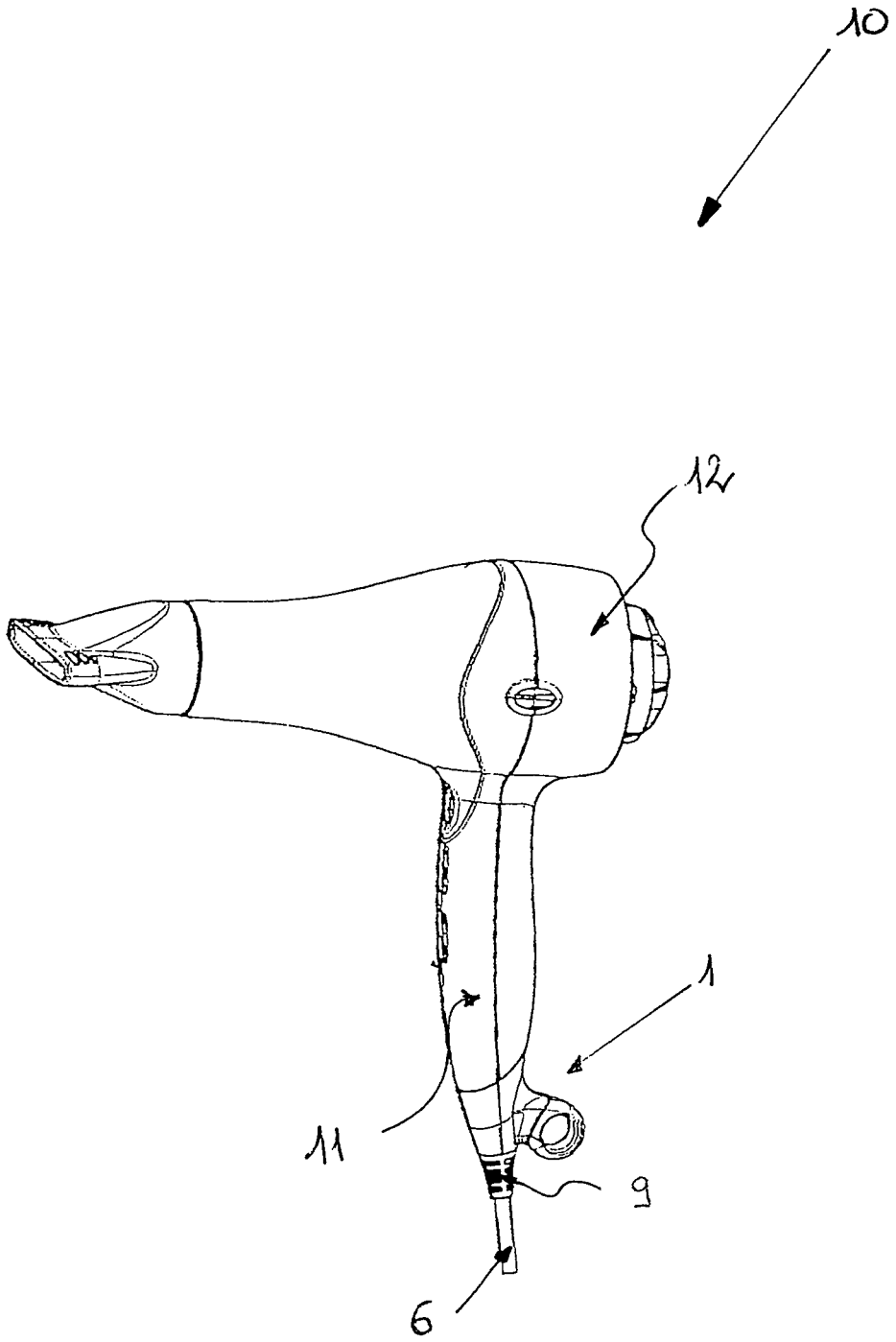
FIG. 3 shows an axonometric view of a hair-drier 10 equipped with the device 1 for electrical connection, according to the invention, to the base of the handle thereof.
Figure 4:
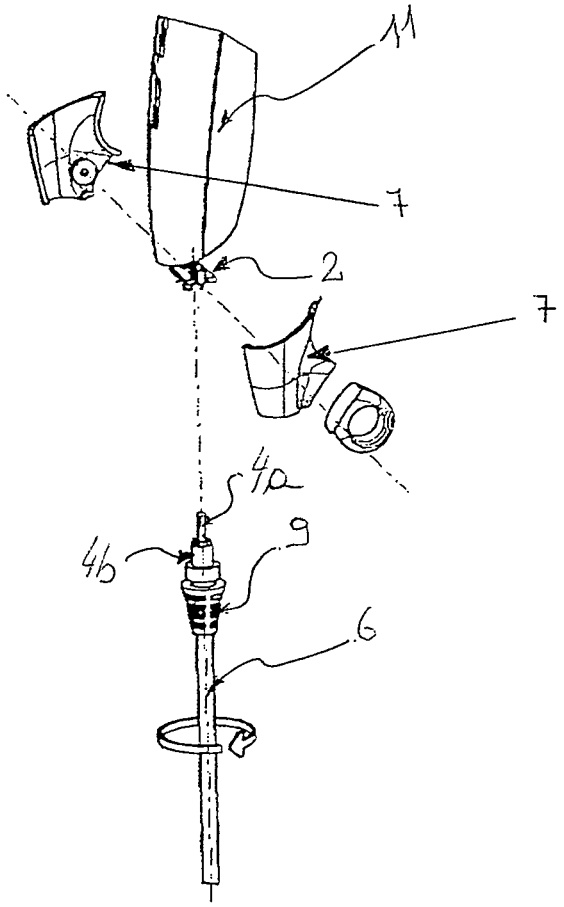
FIG. 4 shows an axonometric and exploded view of a detail of FIG. 3, namely the handle 11 of the body 12 with which the hair-drier 10 (not shown in its entirety) is provided, said handle incorporating the receptacle of the electrical connection device 1. Moreover, said figure shows the male connector 2 separated from the female receptacle 3; the protective body 7 in this embodiment is fixed directly to the base of the handle 11 by means of suitable fixing means.

FIGS. 3-4 show an embodiment in which the connection device 1, according to the invention, is integral with the electric household appliance or the electric tool, there being also shown a hair-drier 10 with the electrical connection device 1 according to one of the preceding embodiments, where said female receptacle 2 is incorporated inside the body 12 of the hair-drier, in this case in the handle 11, whereby said handle may have at one end thereof, in one embodiment, a groove designed to allow rotation of the male connector with respect to the hair-drier handle.

The invention claimed is:

1. A device (1) for electrically connecting electric household appliances or electric tools, comprising:

a female receptacle (2) provided with two seats (8*a*, 8*b*), and a male connector (3) which can be inserted inside said female receptacle (2), wherein said male connector (3) is provided with a first means for electrically contacting (4*a*) with a longitudinal axis (A-A) and a second means for electrically contacting (4*b*), wherein said male connector (3) is also provided with a plastic body (5) to which the first means for electrically contacting (4*a*) and the second means for electrically contacting (4*b*) are fixed, wherein the first means for electrically contacting (4*a*) and the second means for electrically contacting (4*b*) are concentric with each other, wherein said first means for electrically contacting (4*a*) and said second means for electrically contacting (4*b*) can be removably inserted inside said seats (8*a*, 8*b*), with which the female receptacle (2) is provided, so as to allow continuous rotation of the male connector (3) with respect to the female receptacle (2) about the longitudinal axis (A-A).

2. The device for electrically connecting electric household appliances or electric tools according to claim 1, wherein the connector is provided with means (9) for protecting against breakages caused by flexing.

3. The device for electrically connecting electric household appliances or electric tools according to claim 1, wherein said device is enclosed inside a protective body (7) made of plastic.

4. The device for electrically connecting electric household appliances or electric tools according to claim 1, wherein the first electrical contact means (4*a*) is a pin (4*a*).

5. The device for electrically connecting electric household appliances or electric tools according to claim 1, wherein the second means for electrically contacting (4*b*) is a ring (4*b*).

6. A hair-drier (10) comprising the electrical connection device according to claim 1, wherein said female receptacle (2) is incorporated inside a body (12) of the hair-drier (10), in particular at one end of a handle of the hair-drier (11).

7. The device for electrically connecting electric household appliances or electric tools according to claim 4, wherein the second means for electrically contacting (4*b*) is a ring (4*b*) having a greater diameter than the pin (4*a*)

wherein the ring (4*b*) surrounds the pin (4*a*).

* * * * *

UNITED STATES PATENT AND TRADEMARK OFFICE

CERTIFICATE OF CORRECTION

PATENT NO. : 8,478,115 B2
APPLICATION NO. : 12/920639
DATED : July 2, 2013
INVENTOR(S) : Soresina et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 317 days.

Signed and Sealed this
Eighth Day of September, 2015

Michelle K. Lee

Michelle K. Lee
*Director of the United States Patent and Trademark Office*